United States Patent [19]

Dennard

[11] Patent Number: 4,574,397

[45] Date of Patent: Mar. 11, 1986

[54] ARTICLE USED AS GARMENT AND SLEEPING BAG

[76] Inventor: David G. Dennard, 55 Conestee St., Asheville, N.C. 28801

[21] Appl. No.: 525,275

[22] Filed: Aug. 22, 1983

[51] Int. Cl.[4] ..... A41D 15/04; A45F 4/00

[52] U.S. Cl. ..... 2/69.5; 2/84; 2/86; 2/126

[58] Field of Search ..... 2/69.5, 69, 70, 72, 2/86, 89, 84, 94, 126

[56] References Cited

U.S. PATENT DOCUMENTS

| | | | |
|---|---|---|---|
| 3,555,567 | 1/1971 | Owen | 2/69.5 |
| 4,067,066 | 1/1978 | Bruno | 2/69.5 X |
| 4,158,892 | 6/1979 | Gonzales | 2/69.5 |
| 4,217,663 | 8/1980 | Goldberg et al. | 2/86 |
| 4,347,629 | 9/1982 | Itoi | 2/69.5 X |

*Primary Examiner*—Werner H. Schroeder
*Assistant Examiner*—J. L. Olds

[57] ABSTRACT

A garment, sleeping bag, tote bag combination formed from a plurality of sections made of flexible material joined to form a bag having a closable opening therein, sleeves associated with the bag, and adjusting means to include or remove sections to adjust its size. The bag has identical ends and is foldable upon itself to form a jacket or vest of a predetermined size when the ends are aligned.

14 Claims, 12 Drawing Figures

ARTICLE USED AS GARMENT AND SLEEPING BAG

BACKGROUND, OBJECTIVES AND BRIEF SUMMARY OF THE INVENTION

It is desirable to minimize the weight of the backpack load for the hiker to achieve maximum comfort and efficiency, however it is essential that sufficient apparel and equipment are provided for survival and comfort. Various devices have been developed to provide the hiker an item capable of achieving two or more functions. See, for example, U.S. Pat. Nos. 4,103,377 and 4,125,910. While the articles disclosed in these patents achieve the objective of reducing the number of items to be carried, they are of complex construction and are obviously expensive to fabricate.

An objective of the present invention is to provide a garment, sleeping bag, and tote bag combination that is simple in construction and relatively inexpensive to fabricate because it is formed of a plurality of identical sections made from flexible material that can be cut simultaneously in large quantities.

A further objective of the present invention is to provide a combination item which is adjustable in size thus enabling the production of a single unit to serve a large variety of users.

The objectives of this invention are obtained by joining a plurality of symmetrical sections to form a bag with a closable opening, providing sleeves which may be removable, and incorporating means to adjust the size of the bag by enveloping portions of or one or more of the sections and thereby effectively removing all or portions thereof from the bag to reduce its size. The bag is foldable upon itself to form a jacket or vest, depending upon whether or not the sleeves are removed, of a predetermined size. The zippers effectively function as adjusting means in the preferred embodiment of the present invention. The jacket or vest formed from the bag may be reversible so that, for example, it may have a brightly colored side for the deer hunter and a camouflaged side for the hunter who wishes to remain concealed. It is also provided with removable straps so that it can be conveniently carried and used as a tote bag when not functioning as a sleeping bag or a garment.

BRIEF DESCRIPTION OF THE DRAWINGS

The objectives and features of the present invention will become more apparent when reference is made to the following detailed description and illustrative embodiment of the invention taken together with the accompanying drawings in which like characters of reference designate like parts throughout the several views and in which.

DETAILED DESCRIPTION OF THE PREFERRED EMBODIMENT

Figure 1:
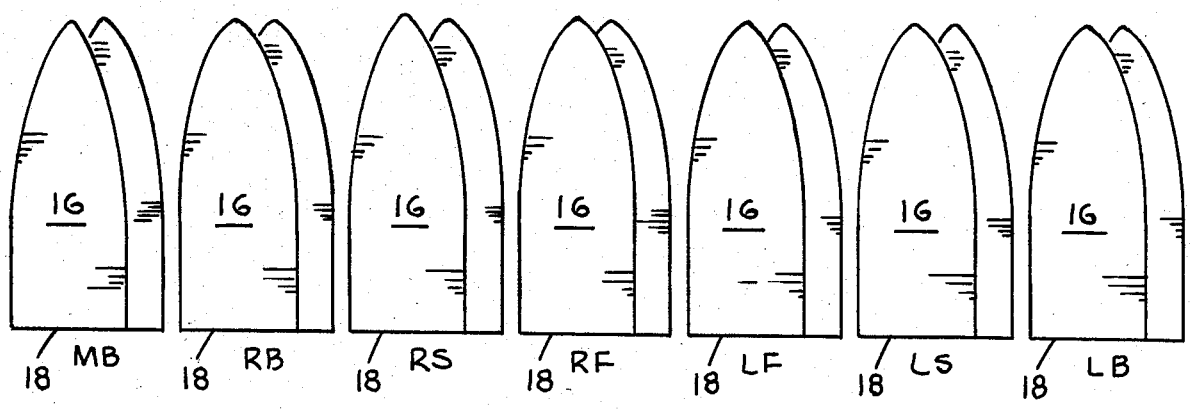
FIG. 1 is a plan view of one embodiment of the sections utilized in the present invention.

Referring now to the drawings and particularly to FIG. 1, a plurality of identical sections 16 are utilized to form this illustrative embodiment of the present invention. The sections in FIG. 1 are made up of 7 pairs, the members of each pair being joined along a common edge 18. The use of such pairs is preferable when a variety of colors or materials in the article are desired. It is, however, more efficient to utilize the symmetrical sections shown in FIG. 2 to avoid forming the seam along edge 18 and thereby reducing the fabrication cost.

Figure 2:
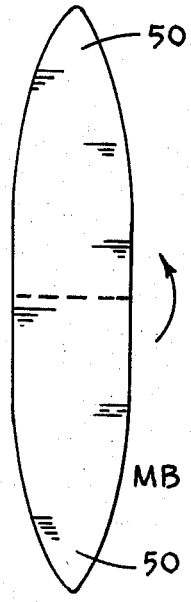
FIG. 2 is a plan view of another embodiment of the sections used in forming the present invention.
Figure 3:
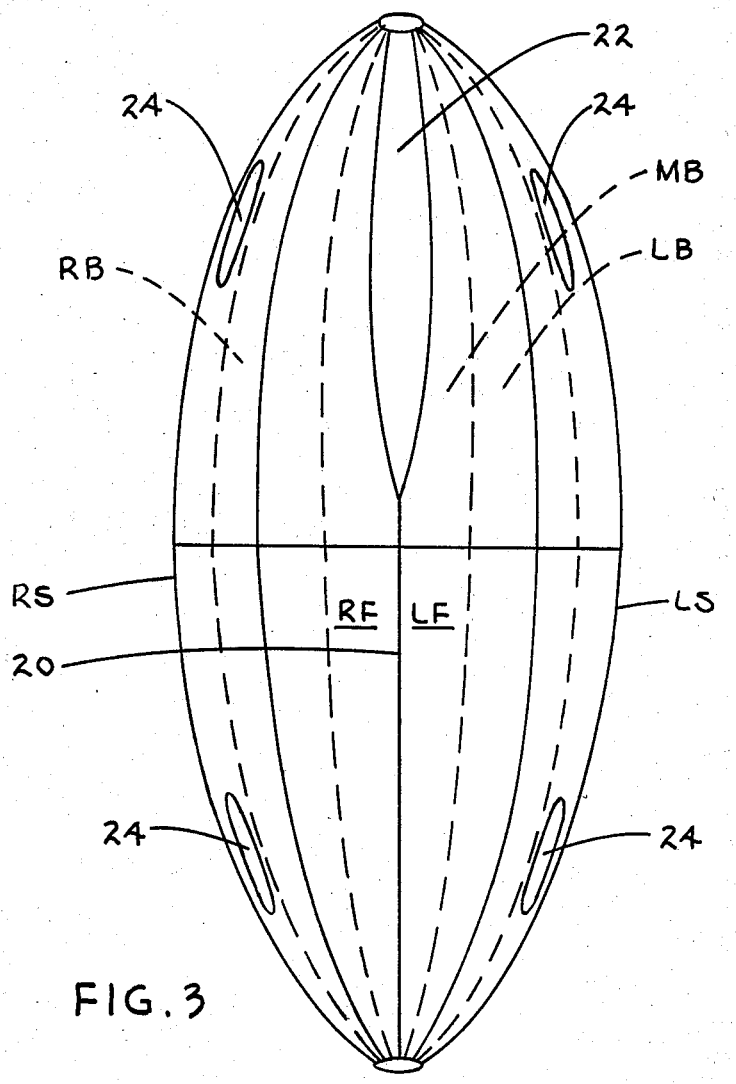
FIG. 3 is a perspective view of a portion of the invention showing the symmetrical sections forming the sleeping bag and identifying the various sections included therein.

The sections in FIGS. 1 and 2 have been given letter designations MB, RB, RS, RF, LF, LS, and LB. These abbreviations refer to "middle back," "right back," "right side," and the like. These designations appear in the sleeping bag portion of the present invention shown in FIG. 3. Thus the 7 section pairs of FIG. 1 or 7 symmetrical sections like the section of FIG. 2 are sewn along their respective edges to form the sleeping bag shell of FIG. 3. The openable portion of the bag designated 20 is closable by means of zippers so that a portion 22 of the opening can remain open to enable the user to breath normally. Sleeve openings 24 are provided in the RS and LS sections and will be more particularly discussed and described subsequently herein.

Figure 4:
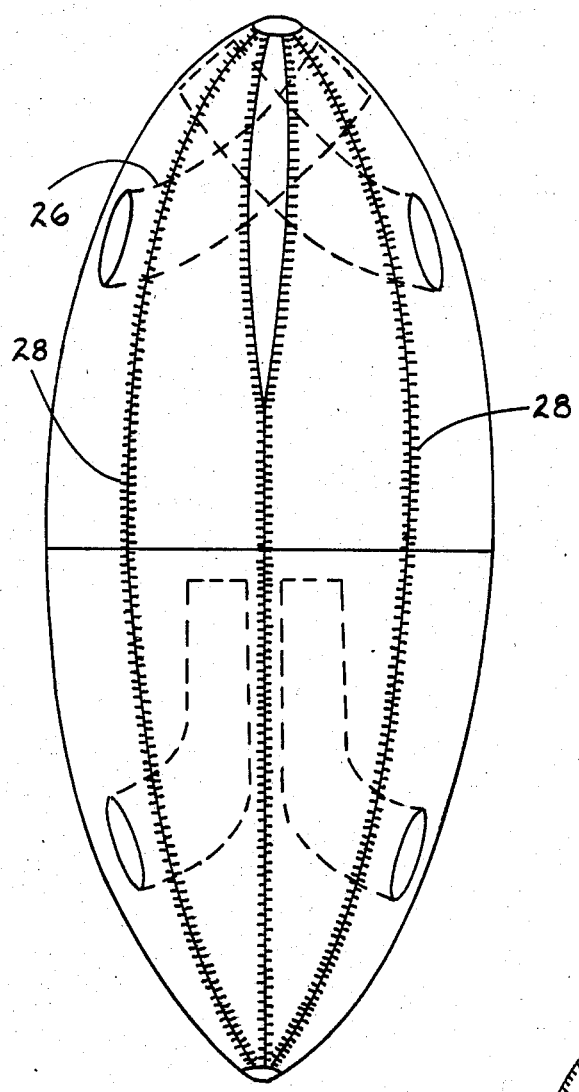
FIG. 4 is a perspective view of the sleeping bag portion of the present invention illustrating the positioning of removable sleeves within the bag to form pillows.

The complete sleeping bag portion of the present invention is shown in FIG. 4 with the sleeves 26 pulled inside the bag. The bag may be used with the sleeves 26 in this position to form pillows, however the sleeves can be removed and used as the user desires. The bag illustrated in FIG. 4 also shows the opened portions 28 of zippers forming size adjusting means that will be more particularly described later.

Figure 5:
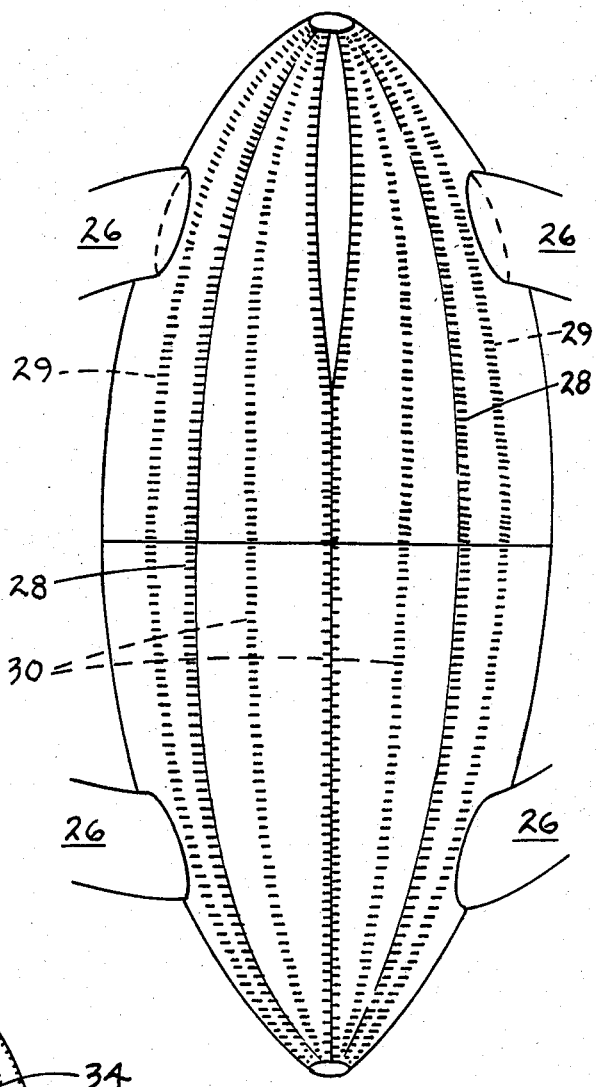
FIG. 5 is a perspective view of the sleeping bag forming a part of the present invention and illustrating the positioning of the sections, the sleeves, and various zippers that provide the means to adjust the size of the bag.

FIG. 5 shows the bag of FIG. 4 having the sleeves 26 extending outwardly from sections RS and LS, and again the bag can be used in this manner if desired. FIG. 5 also shows portions 28 (in solid lines) and 29 (in broken lines) of zippers forming the size adjusting means. Portions 30 (in broken lines) of a zipper forming an additional part of the size adjusting means enables section MB to be enveloped and effectively removed from the bag and the garment to be formed therefrom in a manner subsequently to be described.

Figure 6:
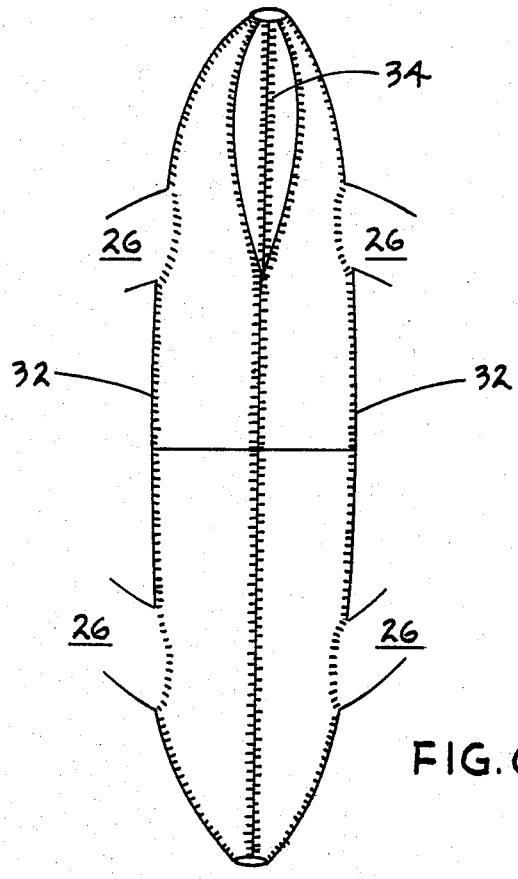
FIG. 6 is a perspective view of the sleeping bag portion of the present invention wherein selective sections have been enveloped by the utilization of several zippers and thereby effectively removed from the bag.

In FIG. 6, zipper portions 28 and 29 have been joined to form closed zippers 32 thereby effectively removing sections RS and LS from the structure of the bag and garment formed therefrom. Zipper portions 30 have been joined to form zipper 34 that extends along the entire backside of the bag thus effectively removing section MB as referenced earlier. By effectively removing sections RS, MB and LS, the diameter of the bag has been greatly reduced. It will be obvious that section MB can be removed or left in an active functioning state as desired depending upon the size of the wearer. It will also be apparent that the portions of one or more sections may be varied in size by utilizing zippers or other suitable releasably securing means in appropriate locations within the section or sections.

Figure 7:
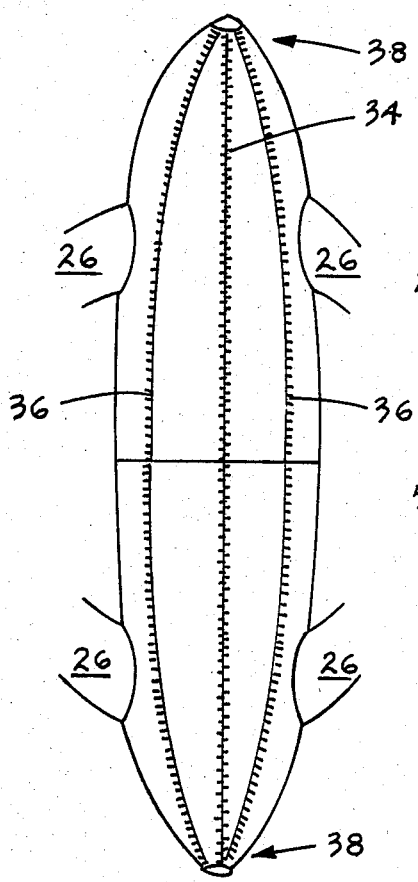
FIG. 7 is a perspective view of the sleeping bag portion of the present invention which has been opened in front.
Figure 8:
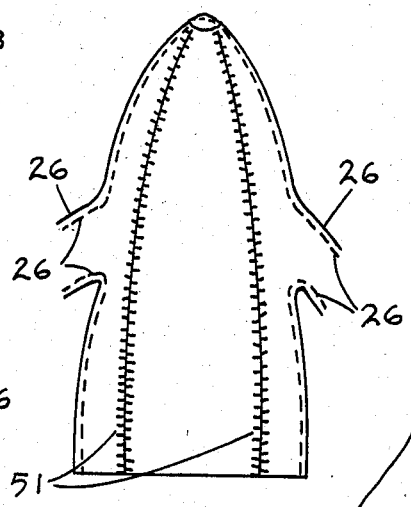
FIG. 8 illustrates the basic formation of the jacket or vest portion of the present invention wherein the sleeping bag has been folded upon itself and its two identical ends aligned to form a double layered jacket or vest shell.

In FIG. 7, zipper 20 has been opened and yields two zipper portions 36. The bag portion of the article is now in condition to be folded upon itself so that its two identical ends shown generally as 38 are aligned (see FIG. 8). The pair of sleeves 26 in one of the identical ends telescopes within the pair in the other end. When the bag is folded upon itself and identical ends 38 are aligned, a double layered jacket or vest shell is formed like that shown in FIG. 8.

Figure 9:
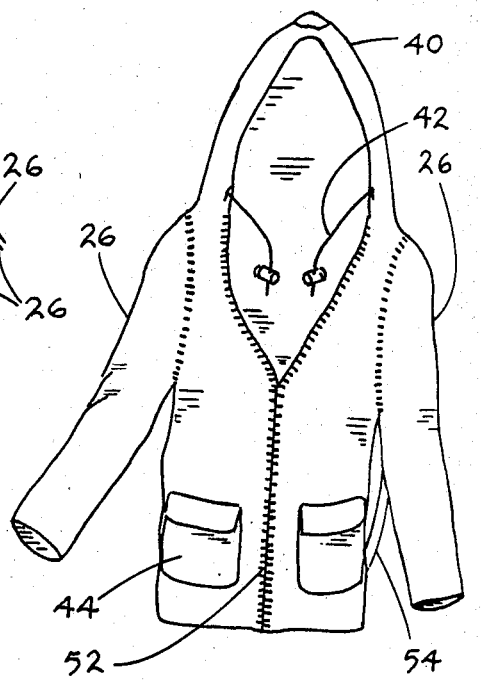
FIG. 9 is a perspective view of the jacket portion of the present invention showing the hood portion of the jacket and the adjustable means associated with that portion causing it to conform to the head shape of the wearer.

The jacket shell includes a hood portion 40 and has a drawstring 42 or other suitable means associated therewith for adjusting the hood portion to conform to the head shape of the wearer. FIG. 9 illustrates the completed garment portion of the present invention with removable sleeves attached to form a jacket. Pockets 44 or other functional exterior devices can be affixed to the appropriate section or sections of the garment as desired.

Figure 11:
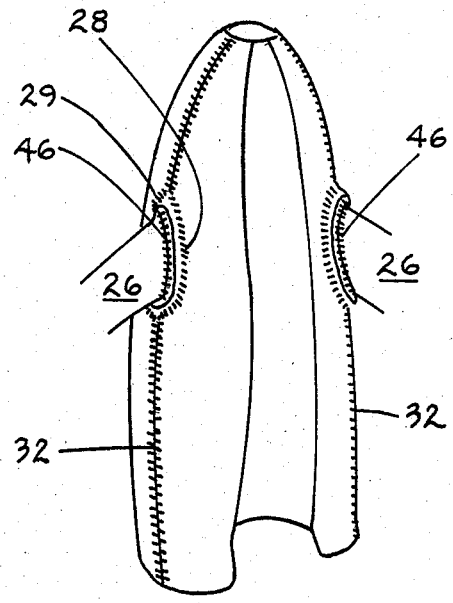
FIG. 11 is a perspective view of the jacket portion of the present invention showing the jacket shell in association with the removable sleeves and the manner in which zippers function to cause the appropriate panels to encircle the sleeves.
Figure 12:
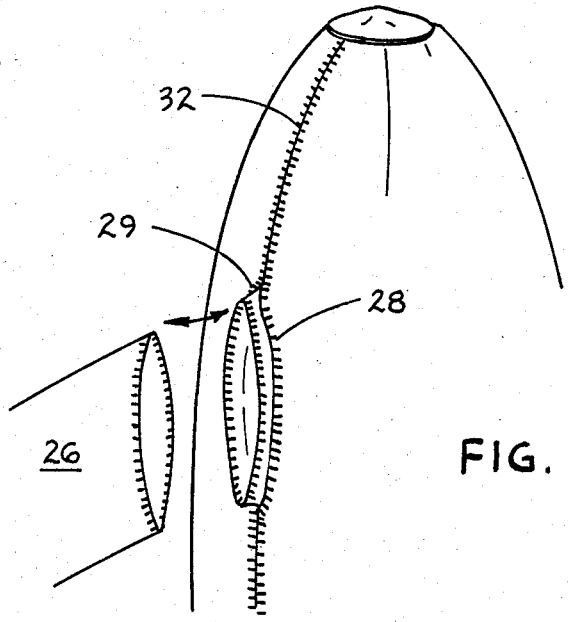
FIG. 12 is a perspective fragmentary view of the jacket shell shown in FIG. 11 wherein a removable sleeve has been removed enabling the opening for the sleeve in the appropriate section to be closed by an appropriate zipper.

FIGS. 11 and 12 illustrate the attachment and removal of removable sleeves 26 and the use of zipper 32 to fashionably encompass the zippered junction 46 of sleeves 26 to the garment shell. Zipper portions 28 and 29 remain unjoined to enable sleeves 26 to extend in the manner shown. The use of multiple zippers on portions 28 and 29 provide the adjustability of the sleeve opening that is needed.

Figure 10:
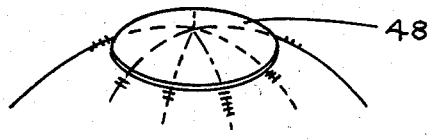
FIG. 10 is a perspective fragmentary view of one end of the sleeping bag portion of the present invention illustrating the technique for joining the pointed ends of the symmetrical sections by applying a disc or cap thereover.

FIG. 10 illustrates the use of a cap or disc 48 that covers the junction formed by the pointed ends 50 of the sections. These ends 48 strengthen this junction and provide a natural stop for the various zippers used throughout the article to open it, close it, and thereby adjust its size. Another separate zipper 51 is used to releasably secure the bag identical ends 38 to each other when the bag is folded upon itself and the ends are aligned. This zipper closes the two layers of fabric at the openable portion of the jacket shell formed thereby and thus gives the outward appearance of a single layer of fabric. Yet another additional zipper 52 extends along a area of the openable portion of the jacket to close the front of the jacket around the wearer.

Thus the present invention utilizes the concept of developing a symmetrical bag portion which can be folded upon itself to form a two layered jacket, one layer of which is the mirror image of the other. The size of the article is varied by acting upon appearing or disappearing panels or portions thereof. It can be provided with carrying means such as removable straps 54 for convenience in carrying as a tote bag when it is not being used as either a sleeping bag or a jacket or vest.

The present invention has considerable flexibility in that two bags may be combined to form a heavy weight garment or bag or to form a bag of doubled capacity depending upon how the bags are joined together. Such combinations also permit the availability of a wider range of colors.

Since obvious changes may be made in the embodiment of the invention described herein, such modifications being within the spirit and scope of the invention claimed, all matter contained herein is intended as illustrative and not as limiting in scope.

Having thus described the invention, what I claim as new and desire to secure by Letters Patent of the United States is:

1. An article fitted with sleeves that extend from closable openings in the article to enable the article to serve alternatively as a garment in which the wearer may walk about or as a sleeping bag, said article comprising: a plurality of sections made of flexible material joined to form a bag having one or more closable openings therein; sleeves associated with said bag; and means adjusting the size of said bag by enveloping one or more of said sections thereof, said bag also being foldable within itself to form a jacket or vest of a predetermined size.

2. The article as claimed in claim 1 wherein said sections are symmetrical and identical and said jacket is hooded.

3. The article as claimed in claim 1 further comprising means associated with the hood of said jacket or vest for causing said hood to conform to the head shape of the wearer.

4. The article as claimed in claim 1 wherein said size adjusting means includes a plurality of zippers selectively positioned along said bag to envelop one or more of said sections and thereby reduce the size of said bag and said jacket or vest formed therefrom.

5. The article as claimed in claim 1 wherein said bag is symmetrical, includes two identical ends, and forms a double layered jacket or vest when said bag is folded upon itself and said ends are aligned.

6. The article as claimed in claim 5 wherein said sleeves are removable and included in each of said bag identical ends.

7. The article as claimed in claim 5 further including means releasably securing said bag indentical ends when said bag is folded upon itself and said ends are aligned.

8. The article as claimed in claim 3 wherein said size adjusting means includes a plurality of zippers selectively positioned along said bag to envelop one or more of said sections and thereby reduce the size of said bag and said jacket or vest formed therefrom.

9. The article as claimed in claim 4 wherein said bag is symmetrical, includes two identical ends, and forms a double layered jacket or vest when said bag is folded upon itself and said ends are aligned.

10. The article as claimed in claim 3 wherein said bag is symmetrical, includes two identical ends, and forms a double layered jacket or vest when said bag is folded upon itself and said ends are aligned.

11. The article as claimed in claim 9 wherein said sleeves are removable and included in each of said bag identical ends.

12. The article as claimed in claim 11 further including means releasably securing said bag identical ends when said bag is folded upon itself and said ends are aligned.

13. The article as claimed in claim 12 wherein a pair of said sleeves are included in each of said bag identical ends, one of said pairs telescoping within the other of said pairs when said bag is folded upon itself and said ends are aligned.

14. The article as claimed in claim 1 wherein said formed jacket or vest is reversible.

* * * * *